US010280497B2

(12) United States Patent
Gummert et al.

(10) Patent No.: US 10,280,497 B2
(45) Date of Patent: May 7, 2019

(54) ALUMINIUM BRONZE ALLOY, METHOD FOR THE PRODUCTION THEREOF AND PRODUCT MADE FROM ALUMINIUM BRONZE

(71) Applicant: Otto Fuchs Kommanditgesellschaft, Meinerzhagen (DE)

(72) Inventors: Hermann Gummert, Viersen (DE); Björn Reetz, Krefeld (DE); Thomas Plett, Schmallenberg (DE)

(73) Assignee: OTTO FUCHS KOMMANDITGESELLSCHAFT, Meinerzhagen (DE)

( * ) Notice: Subject to any disclaimer, the term of this patent is extended or adjusted under 35 U.S.C. 154(b) by 235 days.

(21) Appl. No.: 15/119,073

(22) PCT Filed: Mar. 27, 2015

(86) PCT No.: PCT/EP2015/056672
§ 371 (c)(1),
(2) Date: Aug. 15, 2016

(87) PCT Pub. No.: WO2015/150245
PCT Pub. Date: Oct. 8, 2015

(65) Prior Publication Data

US 2017/0051385 A1 Feb. 23, 2017

(30) Foreign Application Priority Data

Mar. 4, 2014 (EP) ..... 14163339

(51) Int. Cl.
*C22C 9/01* (2006.01)
*C22F 1/08* (2006.01)
*B22D 21/00* (2006.01)

(52) U.S. Cl.
CPC ..... *C22F 1/08* (2013.01); *B22D 21/005* (2013.01); *C22C 9/01* (2013.01)

(58) Field of Classification Search
CPC ..... C22C 9/01; C22C 21/14; C22C 21/00; C22C 21/02; C22C 21/06; C22C 1/0425; C22C 30/06; C22F 1/08; C22F 1/057; B22D 27/00; B21C 1/003
USPC ..... 420/469, 473, 475; 148/684, 692, 694, 148/697, 680
See application file for complete search history.

(56) References Cited

U.S. PATENT DOCUMENTS

| | | | | |
|---|---|---|---|---|
| 2,870,051 | A | 1/1959 | Klement | |
| 3,923,500 | A * | 12/1975 | Kitazawa | C22C 9/00 420/475 |
| 5,326,646 | A | 7/1994 | Nakashima et al. | |
| 5,337,872 | A | 8/1994 | Kawamura et al. | |
| 6,699,337 | B2 | 3/2004 | Hatakeyama et al. | |
| 6,933,054 | B2 | 8/2005 | Ohla et al. | |
| 7,214,279 | B2 | 5/2007 | Fischer et al. | |
| 8,388,776 | B2 | 3/2013 | Buscher et al. | |
| 2005/0115645 | A1 | 6/2005 | Fischer et al. | |
| 2006/0016528 | A1 * | 1/2006 | Hatakeyama | C22C 9/02 148/684 |
| 2009/0022620 | A1 | 1/2009 | Weber | |
| 2009/0092517 | A1 | 4/2009 | Kosaka et al. | |
| 2012/0020600 | A1 | 1/2012 | Nishimura et al. | |
| 2014/0166161 | A1 | 6/2014 | Terlinde et al. | |

FOREIGN PATENT DOCUMENTS

| | | | |
|---|---|---|---|
| CN | 101709405 | A | 5/2010 |
| DE | 2239467 | A1 | 2/1973 |
| DE | 19908107 | A1 | 8/2000 |
| DE | 10159949 | C1 | 5/2003 |
| GB | 1385411 | A | 2/1975 |
| JP | 047221033 | A | 8/1992 |
| JP | 10298678 | A | 11/1998 |
| WO | 2004003244 | A1 | 1/2004 |

OTHER PUBLICATIONS

Examination report dated Dec. 5, 2017 in related Japanese application 2016-560495.
Examination report dated Jan. 19, 2018 in related Russian application 2016135072.
Examination report dated Apr. 10, 2018 in related Japanese application 2016-560495.
International Search Report in parent case PCT/EP2015/056672 dated Aug. 24, 2015.
International Preliminary Report on Patentability, Chapter II, in parent case PCT/EP2015/0526672 dated Oct. 24, 2016.
Written Opinion of the International Searching Authority in parent case PCT/EP2015/056672 dated Aug. 24, 2015.
Zhang Sheng-Hua et al: "Microstructure and wear properties of some special brasses", Jixie Gongcheng Cailao—Materials for Mechanical Engineering. Jixie Gongyebu Shanghai Cailiao Yangjiusuo. Shanghai. CN. vol. 28. No. 6. Jun. 30, 2004 (Jun. 30, 2004). pp. 35-38. XP009175887. ISSN: 1000-3738. Entire article.
Unpublished U.S. Appl. No. 15/104,437, filed Jun. 14, 2016.
Anonym: "Kupfer-Aluminium-Legierungen. 1-15 Auflage Mar. 2010". Deutsches Kupferinstitut, Oct. 1, 2010. XP002742081. Dusseldorf. 28 pages. Cited in International Search Report for parent case PCT/EP2015/056672. Entire article.

(Continued)

*Primary Examiner* — Matthew E. Hoban
*Assistant Examiner* — Lynne Edmondson
(74) *Attorney, Agent, or Firm* — Polson Intellectual Property Law P.C.; Christopher R. Sylvain; Margaret Polson

(57) ABSTRACT

An aluminum bronze alloy containing 7.0-10.0% by weight Al; 3.0-6.0% by weight Fe; 3.0-5.0% by weight Zn; 3.0-5.0% by weight Ni; 0.5-1.5% by weight Sn; ≤0.2% by weight Si; ≤0.1% by weight Pb; and the remainder Cu in addition to unavoidable impurities. Also described is an aluminum bronze product having such an alloy composition, and a method for producing such a product from an aluminum bronze alloy.

16 Claims, 2 Drawing Sheets

(56) References Cited

OTHER PUBLICATIONS

Office action dated Nov. 17, 2016 in related Korean application 10-2016-7022732.
"Brinell Hardness", materials.co.uk, Inspiratech 2000 Ltd., <www.materials.co.uk/brinell.htm> (accessed on Aug. 21, 2018)—entire document.

* cited by examiner

ALUMINIUM BRONZE ALLOY, METHOD FOR THE PRODUCTION THEREOF AND PRODUCT MADE FROM ALUMINIUM BRONZE

CROSS-REFERENCE TO RELATED APPLICATIONS

This application claims the benefit of EP 14163339.6 filed Mar. 4, 2014 through PCT/EP2015/056672 filed Mar. 27, 2015.

BACKGROUND OF THE INVENTION

The present disclosure relates to an aluminum bronze alloy and a method for producing an aluminum bronze alloy. The present disclosure further relates to a product made of such an aluminum bronze alloy.

Numerous requirements are imposed on alloys for friction applications, such as those for piston sleeves or axial bearings of a turbocharger. A suitable alloy should have a low coefficient of friction in order to minimize the power loss resulting from friction, and to reduce the generation of heat in the area of frictional contact. In addition, it should be taken into consideration that for typical applications, the friction partners are present in a lubricated environment, and in principle, good adhesion of the lubricant to the alloy is desired. Moreover, during contact with the lubricant under friction load, a stable tribological layer should form which, like the underlying base matrix of the alloy, has a high thermal stability and good heat conductivity. Furthermore, a wide-ranging oil tolerance is desirable so that the alloy and the tribological layers are largely insensitive to changes in the lubricant.

Another objective is to provide an alloy having a high mechanical load capacity, and a sufficiently high 0.2% yield strength in order to minimize plastic deformations under load. In addition, a high tensile strength and hardness should be present in order for the alloy to withstand abrasive and adhesive loads. Furthermore, the dynamic load capacity should be high enough to ensure robustness against impact stresses. Furthermore, a preferably high fracture toughness retards the crack growth rate, starting from microdefects; with regard to defect growth, the alloy is preferably free of residual stresses.

In many cases, suitable alloys for parts under friction load are special brasses, which in addition to copper and zinc as the primary components are alloyed with at least one of the elements nickel, iron, manganese, aluminum, silicon, titanium, or chromium. Silicon brasses in particular meet the requirements stated above; CuZn31Si1 represents a standard alloy for friction applications such as piston sleeves.

Furthermore, it is known to use tin bronzes, which in addition to tin and copper additionally contain nickel, zinc, iron, and manganese, for friction applications or also for mining applications. Another alloy class for parts under friction load is the aluminum bronzes, which in addition to copper and aluminum may contain alloy additives selected from the group comprising nickel, iron, manganese, aluminum, silicon, tin, and zinc. For faster-moving components under friction load, when aluminum bronzes are used, the additional advantage of weight reduction is achieved due to the lightweight element aluminum. With regard to parts under friction load made of brass or red brass, the parts made from the previously known aluminum bronzes are suitable only for relatively slow-moving friction components.

Use of a copper-aluminum alloy having a cover layer of aluminum oxide for use as a bearing material for manufacturing a sliding bearing is known from DE 101 59 949 C1. The cited document discloses an aluminum proportion of 0.01 to 20%, as well as the use of further optional elements from the group comprising iron, cobalt, manganese, nickel, silicon, and tin up to a maximum 20% total, as well as optionally up to 45% zinc. Additional wide-ranging alloy compositions for silicon bronze are described in U.S. Pat. No. 6,699,337 B2, JP 04221033 A, DE 22 39 467 A, and JP 10298678 A.

The foregoing examples of the related art and limitations therewith are intended to be illustrative and not exclusive. Other limitations of the related art will become apparent to those of skill in the art upon a reading of the specification and a study of the drawings.

BRIEF SUMMARY

The following embodiments and aspects thereof are described and illustrated in conjunction with systems, tools and methods which are meant to be exemplary and illustrative, not limiting in scope. In various embodiments, one or more of the above described problems have been reduced or eliminated, while other embodiments are directed to other improvements.

Proceeding from the prior art outlined above, an object of the present disclosure is to provide an aluminum bronze alloy and a product made from an aluminum bronze alloy which are characterized by improved mechanical properties and in particular good adjustability of the material parameters to the static and dynamic loads that are present. A further aim is to provide high corrosion resistance, good oil tolerance, and high thermal stability, as well as sufficient heat conductivity and a low weight. In addition, a method for producing an aluminum bronze alloy and a product made from an aluminum bronze alloy are provided.

One embodiment of an aluminum bronze alloy according to the present disclosure contains:

7.0-10.0% by weight Al;
3.0-6.0% by weight Fe;
3.0-5.0% by weight Zn;
3.0-5.0% by weight Ni;
0.5-1.5% by weight Sn;
≤0.2% by weight Si;
≤0.1% by weight Pb;
and the remainder Cu.

Another embodiment of the aluminum bronze alloy has the following composition:

7.0-9.0% by weight, in particular 7.0-7.8% by weight, Al;
4.0-5.0% by weight Fe;
3.8-4.8% by weight Zn;
3.8-4.1% by weight Ni;
0.8-1.3% by weight Sn;
≤0.2% by weight Si;
≤0.1% by weight Pb;
and the remainder Cu.

All alloy compositions described may contain unavoidable impurities of 0.05% by weight for each element; the overall quantity of impurities should not exceed 1.5% by weight. However, it is preferred for the impurities to be kept as low as possible, and not to exceed a proportion of 0.02% by weight for each element or an overall quantity of 0.8% by weight.

In one embodiment, the ratio of aluminum to zinc is set in a range of 1.4-3.0 based on weight proportions in the aluminum bronze alloy. The ratio of aluminum to zinc may further be set in a range of 1.5-2.0 based on the weight proportions in the aluminum bronze alloy.

The lead content of the alloy is preferably less than 0.05% by weight. The alloy is thus lead-free with the exception of unavoidable impurities.

The alloy is likewise free of manganese with the exception of unavoidable impurities. The fact that this alloy has the special properties described below was also surprising, since previously known copper alloys alloyed with low zinc content generally contain manganese as a mandatory alloy element in order to achieve the desired strength properties.

The combination of the alloy elements aluminum, nickel, tin, and zinc in the described proportions is important for the claimed alloy. In one embodiment, the sum of these elements is not less than 15% by weight and not greater than 17.5% by weight.

The composition of the aluminum bronze alloy according to the present disclosure, after the alloy melt undergoes subsequent hot forming followed by cooling to below 750° C., results in an alloy matrix having a dominant α phase. This state is referred to below as the extrusion state. The chemical composition of the aluminum bronze alloy is preferably set in such a way that in the extrusion state, the proportion of the β phase is less than 1% by volume of the alloy matrix. This alloy solidifies from the melt quasi-directly in the α-β two-phase space. During the hot forming, this preferably results in indirect extrusion, and for the α phase results in dynamic recrystallization followed by static recrystallization, which gives rise to a fine alloy structure. For the β phase portion, during the hot forming the recrystallization process proceeds via dynamic recovery, followed by static recrystallization. In addition, $K_{II}$ and/or $K_{IV}$ phases containing iron and/or nickel aluminides occur.

The structure that is present in the extrusion state is not only characterized by the selection of the aluminum content, but is also determined by the additional alloyed elements. For iron, a grain-refining effect is to be assumed. Tin has a stabilizing effect for the β phase before the extrusion state, having the structure essentially determined by the α phase, near the boundary region for the α-β mixed phase is reached. The selected ratio of aluminum to zinc has proven to be relevant for the extrusion state and the resulting adjustability of the mechanical properties by subsequent cold forming and heat treatment steps.

Compared to a conventional alloy of type CuAl10Ni5Fe4 used for parts under friction load, in the claimed alloy it has proven to be advantageous that, for the same temperature control of a heat treatment above the recrystallization threshold after cooling, this alloy has much lower proportions of the β phase. Therefore, a product made from such an alloy is much more resistant to corrosion than one made from the product made from the previously known alloy mentioned above. In particular for such applications, the relatively high zinc content also has a positive effect, since it allows greater sliding speeds.

Tests have shown that the claimed aluminum bronze alloy no longer has the special properties when the content of one or more of the mandatory elements falls below or exceeds the narrowly claimed ranges. As shown by these tests, the specified special alloy matrix having the very dominant α phase and, if present, only a minor volume portion of the β phase, surprisingly results only within the claimed range.

It has also been shown that, starting from the extrusion state, a high strain hardening for a product made from the aluminum bronze alloy according to the present disclosure is possible which results in a significant increase in the 0.2% yield strength $R_{P0,2}$ and the tensile strength $R_m$. Due to this extensive solidification during the cold forming, the reserve of the alloy for plastic deformation is reduced. For the alloy according to the present disclosure, the accompanying decrease in the elongation at break may be increased by final annealing in a temperature range of 300° to approximately 500° C. with a temperature setting below the solution heat treatment temperature. During final annealing, no reduction in the 0.2% yield strength or the tensile strength occurs, and instead, contrary to expectations, the strength is further increased.

For heat treatment steps which, after the extrusion state is reached, are carried out in such a way that the temperatures used are below the recrystallization threshold and within the solubility range of the α phase, there is no change in the phase composition of the matrix of the extrusion state. However, for a heat treatment in this temperature range, there is surprisingly still wide-ranging adjustability of the mechanical parameters, resulting in an adaptable, high load-capacity product made of the aluminum bronze alloy having a 0.2 yield strength $R_{P0,2}$ in the range of 650-1000 MPa, a tensile strength $R_m$ in the range of 850-1050 MPa, and an elongation at break $A_5$ in the range of 2-8% and preferably in the range of 4-7%. After the hot forming and cold forming and the subsequent annealing, an alloy end state preferably results which additionally has a yield strength to tensile strength ratio in the range of 85-95% and a Brinell hardness of 250-300 HB 2.5/62.5.

The product according to the present disclosure made from the aluminum bronze alloy, when in contact with a wide range of lubricants, forms stable tribological layers under friction load. In the tribological layers, in addition to aluminum oxide, zinc is incorporated in combination with lubricant components, as well as a quantity of tin which ensures sufficient emergency running capability is diffused. Therefore, tin is involved in the structure of the alloy in the claimed range in order to be present in sufficient quantities in dissolved form in the matrix and thus ensure the specified emergency running capability. In addition, it has been shown that tin is an effective diffusion barrier which hinders other elements from diffusing out of the alloy. Furthermore, hard phase depositions in the form of intermetallic $K_{II}$ and/or $K_{IV}$ phases containing iron and/or nickel aluminides are present which represent high load-capacity contact points of the friction layer in a more ductile base matrix.

The aluminides preferably form at the grain boundaries of the α matrix of the alloy, whereby the average grain size of the α matrix is ≤50 μm in the alloy end state. Due to the alloy forming, the intermetallic $K_{II}$ and/or $K_{IV}$ phases assume an elongated shape with an average length of ≤10 μm, and an average volume of ≤1.5 $\mu m^2$. Due to indirect extrusion during hot forming, an orientation in the direction of extension takes place which is hardly influenced by the subsequent cold forming. In addition, an additional deposition of aluminide is observed which results in intermetallic phases having a rounded shape and an average size of ≤0.2 μm in the alloy end state after the subsequent annealing. The grain size of the α matrix is preferably ≤20 μm, and in particular is in the range of 5 to 10 μm.

The method according to the present disclosure is based on the alloy composition described above, and uses a hot forming process, preferably indirect extrusion, after the alloy components are melted. According to one embodiment, the subsequent cold forming is carried out as cold drawing with a degree of deformation in the range of 5-30%.

An alloy composition is preferred which results in an extrusion state which, after cooling, allows direct cold forming without further heat treatment. The alloy end state of a product made from the aluminum bronze alloy thus has an α matrix with a maximum β phase proportion of 1% by volume, preferably already in the extrusion state. If the β phase proportion in the extrusion state is higher, soft annealing may alternatively take place in a temperature range of 450-550° C. between hot forming and cold forming.

The temperature during the final annealing after the cold forming step is selected in such a way that the alloy is temperature-controlled below the solution heat treatment temperature in a range of 300° to approximately 500° C. In one embodiment, this heat treatment step is carried out only up to a maximum temperature of 400° C. This results in a 0.2% yield strength in the range of 650-1000 MPa, a tensile strength $R_m$ in the range of 850-1050 MPa, and an elongation at break $A_5$ in the range of 2-8% and preferably in the range of 4-7%, without using temperature-controlled cooling. The final annealing influences primarily the elongation at break $A_5$, so that this parameter is selectively settable over a wide range. The 0.2% yield strength and the tensile strength $R_m$, starting from a defined extrusion state, are selected in particular based on the choice of the rate of deformation during cold drawing. Due to the particularly good strain hardening properties of a semi-finished product or component made from the described alloy, the yield strength may be improved by a factor of at least 1.5 compared to conventional alloys.

The alloy according to the present disclosure is suitable for friction loads that are constant over time, and due to its special properties, is also suitable in particular for producing a component that is acted on by a friction load that is variable over time, for example a bearing bush for a bearing of a piston shaft, a slide shoe, or a worm gear under high friction load. Another possible use of a component made from the alloy is an axial bearing for a turbocharger. A friction load that is variable over time may also result in inadequate lubrication; the tin content in the alloy ensures that the component subjected to such a load also meets the requirements in question. Lastly, the claimed alloy is suited for various types of wear parts, such as gear wheels or worm gears. This alloy is also suitable for forming a friction lining in the manner of a friction coating for a friction partner of a friction pair.

BRIEF DESCRIPTION OF THE DRAWINGS

The invention is further explained below based on one exemplary embodiment with reference to the following figures.

In addition to the aspects and embodiments described above, further aspects and embodiments will become apparent by reference to the accompanying drawings and the detailed description forming a part of this specification.

DETAILED DESCRIPTION

For one exemplary embodiment, the alloy composition was melted and hot-formed by means of vertical continuous casting at a casting temperature of 1170° C. and a casting speed of 60 mm/min at a pressing temperature of 900° C.

The alloy in question has the following composition:

| Cu | Zn | Pb | Sn | Fe | Mn | Ni | Al |
|---|---|---|---|---|---|---|---|
| Remainder | 4.64 | 0.01 | 1.01 | 4.08 | 0.03 | 3.90 | 7.30 |

Figure 1:
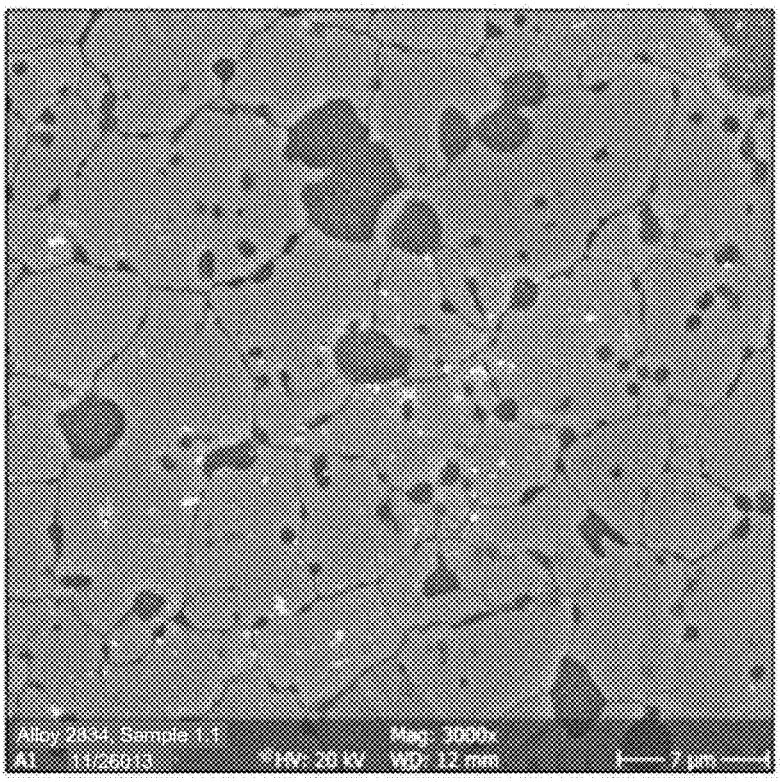
FIG. 1: shows a scanning electron micrograph of the aluminum bronze alloy according to the present disclosure with a 3000× magnification.
Figure 2:
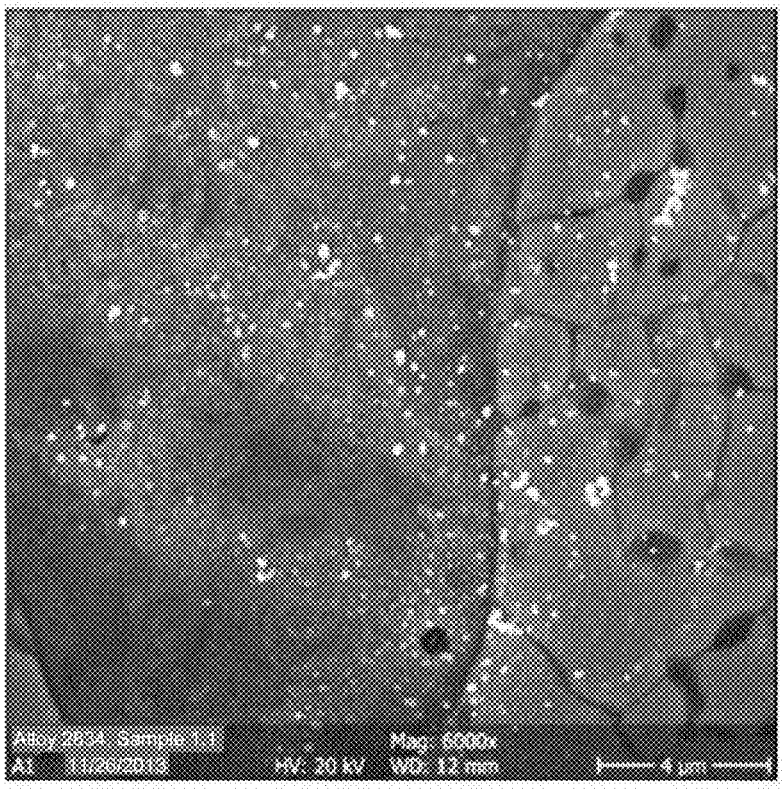
FIG. 2: shows a scanning electron micrograph of the aluminum bronze alloy of FIG. 1 with a 6000× magnification.
Figure 3:
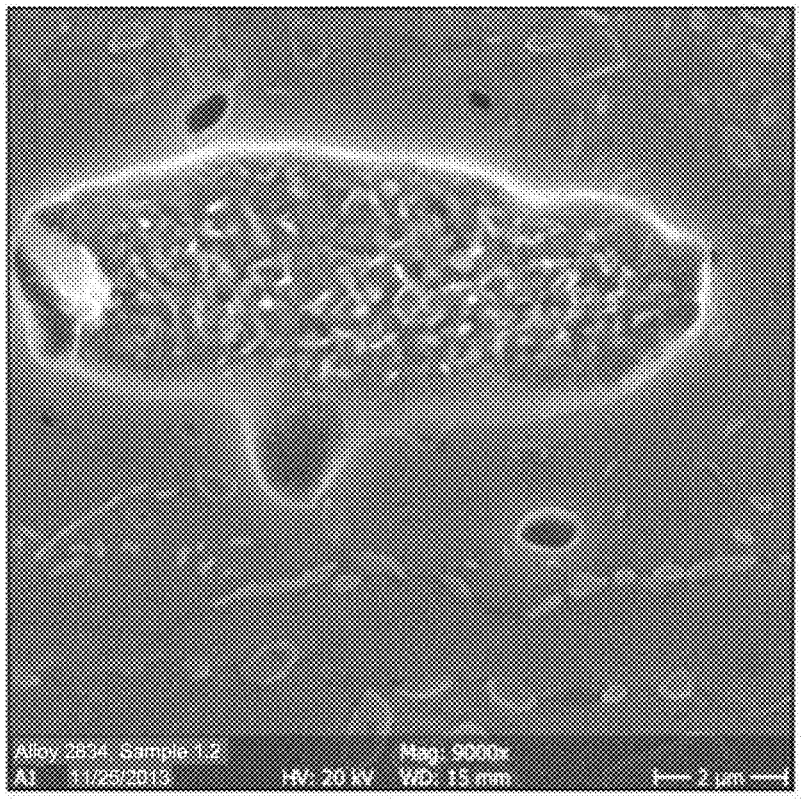
FIG. 3: shows a scanning electron micrograph of the aluminum bronze alloy of FIG. 1 with a 9000× magnification.

The test alloy present after cooling in the extrusion state was characterized by means of scanning electron micrographs and energy-dispersive analyses (EDX); after cooling, the material state shown in FIGS. 1 and 2 was present. The micrographs depicted in FIGS. 1 and 2, with secondary electron contrast at magnifications of 3000× and 6000×, show an α phase, which forms the alloy matrix, and hard phase depositions in the form of $K_{II}$ and $K_{IV}$ phases which are composed of iron and nickel aluminides and which deposit primarily at the grain boundaries. In addition, the micrograph shown in FIG. 3 with a 9000× magnification shows that hard phase depositions with an average size of ≤0.2 μm are additionally present.

For the α phase, EDX measurements showed on average a chemical composition of 84.2% by weight Cu, 5.0% by weight Zn, 4.4% by weight Fe, 3.4% by weight Ni, 2.8% by weight Al, and 0.1% by weight Si. For the $K_{II}$ phases investigated, in the extrusion state an average composition of 15.2% by weight Cu, 2.4% by weight Zn, 67.6% by weight Fe, 9.4% by weight Ni, 4.7% by weight Al, and 0.7% by weight Si was found. In addition, the proportion of intermetallic phases was determined to be 7% by volume, while the β phase proportion in the extrusion state was less than 1% by volume. Measurements of the material states which resulted after the cold forming and heat treatment steps described below showed no change in the phase composition.

For setting the mechanical properties, starting from the extrusion state determined essentially by the chemical composition of the aluminum bronze alloy, soft annealing was carried out at 550° C., followed by cold forming in the form of stretch forming. The soft-annealed intermediate products were prepared for the cold drawing in a soaping bath at 50° C. Different reductions in cross section of 8-25% were selected as process parameters for the stretch forming. In a final treatment step, final annealing of the formed aluminum bronze products was carried out at 380° C. for 5 hours; Table 1 summarizes the average mechanical properties for the 0.2% yield strength $R_{P0,2}$, the tensile strength $R_m$, the elongation at break $A_5$, the Brinell hardness HB, and the yield strength to tensile strength ratio:

| State | $R_{P0.2}$ [MPa] | $R_m$ [MPa] | $A_5$ [%] | HB 2.5/62.5 | Yield strength to tensile strength ratio [%] |
|---|---|---|---|---|---|
| Extrusion state | 360 | 690 | 26 | 176 | 48.8 |
| Cold forming 8% reduction in cross section | 700 | 810 | 9.6 | 211 | 85.7 |
| Cold forming 15% reduction in cross section | 840 | 840 | 6.1 | 225 | 86.9 |
| Cold forming 20% reduction in cross section | 850 | 930 | 5.5 | 233 | 91.2 |

-continued

| State | $R_{P0.2}$ [MPa] | $R_m$ [MPa] | $A_5$ [%] | HB 2.5/62.5 | Yield strength to tensile strength ratio [%] |
|---|---|---|---|---|---|
| Cold forming 25% reduction in cross section | 830 | 950 | 3.9 | 242 | 87.0 |
| Final annealing 380° C./5 h (after 8% reduction in cross section) | 830 | 870 | 5.9 | 250 | 95.1 |
| Final annealing 380° C./5 h (after 15% reduction in cross section) | 810 | 900 | 6.5 | 260 | 90.3 |
| Final annealing 380° C./5 h (after 20% reduction in cross section) | 850 | 930 | 5.5 | 275 | 91.2 |
| Final annealing 380° C./5 h (after 25% reduction in cross section) | 940 | 1000 | 2.5 | 291 | 94.1 |

For further measurement series, the final annealing for setting the alloy end state of the aluminum bronze products was carried out below the soft annealing or solution heat treatment temperature. Final annealing temperatures in the range of 300-400° C. were preferably selected for the tests; in combination with a variation in the withdrawal rates of the prior cold forming, a wide range is settable for the mechanical properties of the final alloy state without using complicated measures for temperature-controlled cooling.

It is apparent from this description that the special positive properties of the claimed invention in the narrowly claimed range of the elements involved in the alloy were not expected against the background of the disclosures in the prior art. It was therefore surprising for the inventors to find that by adjusting the alloy parameters in the claimed interval, the data is improved compared to the previously known alloys. This also applies to the surprisingly robust processability of this alloy for setting the desired strength properties.

While a number of exemplary aspects and embodiments have been discussed above, those of skill in the art will recognize certain modifications, permutations, additions and sub-combinations therefore. It is therefore intended that the following appended claims hereinafter introduced are interpreted to include all such modifications, permutations, additions and sub-combinations are within their true spirit and scope. Each apparatus embodiment described herein has numerous equivalents.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. Whenever a range is given in the specification, all intermediate ranges and subranges, as well as all individual values included in the ranges given are intended to be included in the disclosure. When a Markush group or other grouping is used herein, all individual members of the group and all combinations and sub-combinations possible of the group are intended to be individually included in the disclosure.

In general, the terms and phrases used herein have their art-recognized meaning, which can be found by reference to standard texts, journal references and contexts known to those skilled in the art. The above definitions are provided to clarify their specific use in the context of the invention.

The invention claimed is:

1. An aluminum bronze product having an alloy composition containing 7.0-10.0% by weight Al;
3.0-6.0% by weight Fe;
3.0-5.0% by weight Zn;
3.0-5.0% by weight Ni;
0.5-1.5% by weight Sn;
≤0.2% by weight Si;
≤0.1% by weight Pb;
and the remainder Cu in addition to unavoidable impurities;
wherein the aluminum bronze product is adjusted by cold forming, followed by final annealing below a solution heat treatment temperature in a temperature range of 300-500° C., resulting in an alloy end state with a 0.2% yield strength $R_{P0,2}$ of 650-1000 MPa, a tensile strength Rm of 850-1050 MPa, and an elongation at break A5 of 2-8%;
wherein intermetallic KII and/or KIV phases containing iron and/or nickel aluminides are present in the alloy end state.

2. The aluminum bronze product of claim 1, wherein the alloy composition contains 7.0-7.8% by weight Al;
4.0-5.0% by weight Fe;
3.8-4.8% by weight Zn;
3.8-4.1% by weight Ni;
0.8-1.3% by weight Sn;
≤0.2% by weight Si;
≤0.1% by weight Pb;
and the remainder Cu in addition to unavoidable impurities.

3. The aluminum bronze product of claim 1, wherein the ratio of aluminum to zinc is in a range of 1.4-3.0 based on weight proportions in the alloy composition.

4. The aluminum bronze product of claim 1, wherein the alloy end state has a yield strength to tensile strength ratio of 85-97%.

5. The aluminum bronze product of claim 1, wherein the alloy end state has a hardness of 250-300 HB 2.5/62.5.

6. The aluminum bronze product of claim 1, wherein an α matrix with a maximum β phase proportion of 1% by volume is present in the alloy end state.

7. The aluminum bronze product of claim 6, wherein average grain size of the α matrix is ≤50 μm in the alloy end state.

8. The aluminum bronze product of claim 1, wherein the intermetallic KII and/or KIV phases have an elongated shape with an average length of ≤10 μm, and an average volume of ≤1.5 μm2.

9. The aluminum bronze product of claim 8, wherein an additional aluminide deposition having a rounded shape and an average size of ≤0.2 μm is present in the alloy end state.

10. The aluminum bronze product of claim 1, wherein the aluminum bronze product is a component that is acted on by a friction load that is variable over time.

11. A method for producing a product made from an alloy, comprising the steps:

producing a casting blank from a melt containing 7.0-10.0% by weight Al;

3.0-6.0% by weight Fe;

3.0-5.0% by weight Zn;

3.0-5.0% by weight Ni;

≤0.2% by weight Si;

≤0.1% by weight Pb;

and the remainder Cu in addition to unavoidable impurities;

heat forming the casting blank to form an intermediate product;

cold forming the intermediate product, wherein the step of cold forming is carried out as cold drawing with a rate of deformation of 5-30%; and final annealing of the product below a solution heat treatment temperature in a temperature range of 300-500° C., wherein after final annealing, a 0.2% yield strength $R_{P0,2}$ is between 650-1000 MPa, a tensile strength $R_m$ is between 850-1050 MPa, and an elongation at break $A_5$ is between 2-8%.

12. The method of claim 11, wherein the melt for producing the casting blank contains:

7.0-7.8% by weight Al;

4.0-5.0% by weight Fe;

3.8-4.8% by weight Zn;

3.8-4.1% by weight Ni;

0.8-1.3% by weight Sn;

≤0.2% by weight Si;

≤0.1% by weight Pb;

and the remainder Cu in addition to unavoidable impurities.

13. The aluminum bronze product of claim 3, further wherein the ratio of aluminum to zinc is in a range of 1.5-2.0 based on weight proportions in the alloy composition.

14. The aluminum bronze product of claim 1, wherein the elongation at break A5 is 4-7%.

15. The aluminum bronze product of claim 10, wherein the component is a bearing bush, a slide shoe, a worm gear, or an axial bearing for a turbocharger.

16. The method of claim 11, wherein the elongation at break A5 is 4-7%.

* * * * *